US011927198B2

(12) United States Patent
Kogame

(10) Patent No.: US 11,927,198 B2
(45) Date of Patent: Mar. 12, 2024

(54) VACUUM PUMP

(71) Applicant: SHIMADZU CORPORATION, Kyoto (JP)

(72) Inventor: Masahito Kogame, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 136 days.

(21) Appl. No.: 17/556,319

(22) Filed: Dec. 20, 2021

(65) Prior Publication Data

US 2022/0235796 A1 Jul. 28, 2022

(30) Foreign Application Priority Data

Jan. 22, 2021 (JP) ..... 2021-009077

(51) Int. Cl.
*F04D 9/04* (2006.01)
*F04D 19/04* (2006.01)
(Continued)

(52) U.S. Cl.
CPC ..... *F04D 29/584* (2013.01); *F04D 19/042* (2013.01); *F04D 29/522* (2013.01); *F04D 29/644* (2013.01); *F04D 29/684* (2013.01)

(58) Field of Classification Search
None
See application file for complete search history.

(56) References Cited

U.S. PATENT DOCUMENTS 5,924,841 A * 7/1999 Okamura ..... F04D 19/046 415/176
6,910,850 B2 * 6/2005 Nonaka ..... F04D 29/584 415/90
(Continued)

FOREIGN PATENT DOCUMENTS

CN 106415020 A 2/2017
CN 108661926 A 10/2018
(Continued)

OTHER PUBLICATIONS

Office Action for corresponding TW Application No. 11120210580 dated Mar. 4, 2022, with English language translation..
(Continued)

*Primary Examiner* — Kayla Mccaffrey
(74) *Attorney, Agent, or Firm* — Renner, Otto, Boisselle & Sklar, LLP

(57) ABSTRACT

A vacuum pump comprises: a rotor; a stator; a first heating section configured to heat the stator cylindrical portion to a temperature for reducing product accumulation; an exhaust pipe provided at a housing storing the rotor and the stator to discharge gas discharged by the rotor and the stator to an outside of the housing; a second heating section configured to heat the exhaust pipe to a temperature for reducing product accumulation; and a gas passage container arranged in the housing, having an inlet port into which gas discharged through a gap between the rotor cylindrical portion and the stator cylindrical portion flows and an outlet port from which inflow gas flows to the exhaust pipe, and heated to a temperature for reducing product accumulation. A gas-inflow-side end portion of the exhaust pipe is inserted into the outlet port of the gas passage container through a clearance.

12 Claims, 9 Drawing Sheets

(SECTION IN AXIAL DIRECTION)

(51) Int. Cl.

| | |
|---|---|
| ***F04D 29/52*** | (2006.01) |
| ***F04D 29/58*** | (2006.01) |
| ***F04D 29/64*** | (2006.01) |
| ***F04D 29/68*** | (2006.01) |

(56) References Cited

U.S. PATENT DOCUMENTS

| | | | | |
|---|---|---|---|---|
| 10,161,404 | B2 * | 12/2018 | Tsutsui | F04D 29/023 |
| 11,009,040 | B2 * | 5/2021 | Nonaka | F04D 29/522 |
| 11,009,044 | B2 * | 5/2021 | Sakaguchi | F04D 19/042 |
| 2012/0141254 | A1 * | 6/2012 | Ohtachi | F04D 19/042 415/90 |
| 2016/0025096 | A1 * | 1/2016 | Shi | F04D 25/06 417/423.1 |
| 2016/0273552 | A1 | 9/2016 | Tsubokawa | |
| 2017/0002832 | A1 | 1/2017 | Nonaka et al. | |
| 2018/0279415 | A1 | 9/2018 | Moriyama | |

FOREIGN PATENT DOCUMENTS

| | | | |
|---|---|---|---|
| JP | 1997310696 | A | 12/1997 |
| JP | 1999-193793 | A | 7/1999 |
| JP | 2009-275578 | A | 11/2009 |
| JP | 2016-176339 | A | 10/2016 |
| JP | 2017-002856 | A | 1/2017 |

OTHER PUBLICATIONS

Office Action for corresponding CN Application No. 202110868761.9 dated Mar. 31, 2023, with English language..

Office Action for corresponding JP Application No. 2021-009077 dated Nov. 17, 2023, with English language translation.

* cited by examiner (SECTION IN AXIAL DIRECTION)

(SECTION ALONG C1-C1 LINE)

(SECTION IN AXIAL DIRECTION)

(SECTION ALONG C1-C1 LINE)

VACUUM PUMP

BACKGROUND OF THE INVENTION

1. Technical Field

The present invention relates to a vacuum pump.

2. Background Art

A turbo-molecular pump is used as an exhaust pump for various semiconductor manufacturing devices, but a reactive product is accumulated in the pump when pumping is performed at, e.g., an etching process. Generally, a turbo-molecular pump including a turbo pump portion and a screw groove pump portion is used for the semiconductor manufacturing device, but the reactive product is likely to be accumulated on a lower-vacuum side. For this reason, a structure for heating a stator side of the screw groove pump portion to a high temperature is employed in many cases. However, product accumulation in the screw groove pump portion is reduced by stator heating, but there is a problem that the product is accumulated in an exhaust gas passage downstream of the screw groove pump portion.

For example, a technique described in Patent Literature 1 (JP-A-2016-176339) employs, for reducing product accumulation in an exhaust pipe as part of a downstream exhaust gas passage, such a configuration that a pipe fixed to a stator is inserted into an exhaust port. Exhaust gas is discharged to the outside of a pump through the pipe, and therefore, product accumulation on an exhaust port inner peripheral surface is prevented.

SUMMARY OF THE INVENTION

However, it is configured such that gas discharged from a screw groove pump portion flows into the pipe after having been discharged to a downstream flow path of the screw groove pump portion. Thus, there is a problem that a product is accumulated on an inner peripheral surface of the downstream flow path between the pipe and the screw groove pump portion. That is, in the vacuum pump described in Patent Literature 1, product accumulation on the exhaust port inner peripheral surface is prevented, but the product is accumulated on an inner peripheral surface of an exhaust passage (the flow path downstream of the screw groove pump portion) connected from the screw groove pump portion to the exhaust port.

A vacuum pump comprises: a rotor formed with multiple stages of rotor blades and a rotor cylindrical portion; a stator formed with multiple stages of stationary blades and a stator cylindrical portion arranged with a predetermined gap from the rotor cylindrical portion; a first heating section configured to heat the stator cylindrical portion to a temperature for reducing product accumulation; an exhaust pipe provided at a housing storing the rotor and the stator to discharge gas discharged by the rotor and the stator to an outside of the housing; a second heating section configured to heat the exhaust pipe to a temperature for reducing product accumulation; and a gas passage container arranged in the housing, having an inlet port into which gas discharged through a gap between the rotor cylindrical portion and the stator cylindrical portion flows and an outlet port from which inflow gas flows to the exhaust pipe, and heated to a temperature for reducing product accumulation. A gas-inflow-side end portion of the exhaust pipe is inserted into the outlet port of the gas passage container through a clearance.

The outlet port is a tunnel-shaped hole, and the gas-inflow-side end portion of the exhaust pipe is inserted such that a clearance is formed between the gas-inflow-side end portion and a wall surface of the tunnel-shaped hole.

The gas passage container is a ring-shaped container, and the inlet port is a ring-shaped opening facing an entirety of gas exhaust regions of the rotor cylindrical portion and the stator cylindrical portion.

The gas passage container is heated by the first heating section.

The gas passage container is fixed to the stator cylindrical portion, and is heated by the first heating section through the stator cylindrical portion.

The vacuum pump further comprises: a purge gas injection portion for injecting purge gas into a space surrounding the gas passage container. The gas injected into the surrounding space prevents gas discharged from the gap between the rotor cylindrical portion and the stator cylindrical portion from leaking to a periphery of the gas passage container.

The exhaust pipe includes, in addition to the gas-inflow-side end portion inserted into the outlet port through the clearance, a raised portion arranged in parallel with the gas-inflow-side end portion and protruding inward of the housing, and part of a wall portion of the gas passage container is arranged between the gas-inflow-side end portion and the raised portion through a clearance.

The clearance forms a labyrinth-like structure.

The gas passage container is a ring-shaped container, and has an outer peripheral wall fixed to the stator cylindrical portion, an inner peripheral wall, and a bottom wall.

Multiple bolt holes having counterbores are formed at the outer peripheral wall, and utilizing the bolt holes, the outer peripheral wall of the gas passage container is fixed to a lower end surface of the stator cylindrical portion.

A clearance is formed between the gas-inflow-side end portion of the exhaust pipe and the stator cylindrical portion.

The dimension of the clearance is g, the amount of insertion of the gas-inflow-side end portion of the exhaust pipe is L, and $L=\alpha \cdot g$ is satisfied, the degree of $\alpha$ is set to 2 or greater.

According to the present invention, product accumulation on a surface of a member forming a gas passage from an exhaust functional section to an exhaust pipe can be reduced.

DETAILED DESCRIPTION OF THE EXEMPLARY EMBODIMENTS

Figure 1:
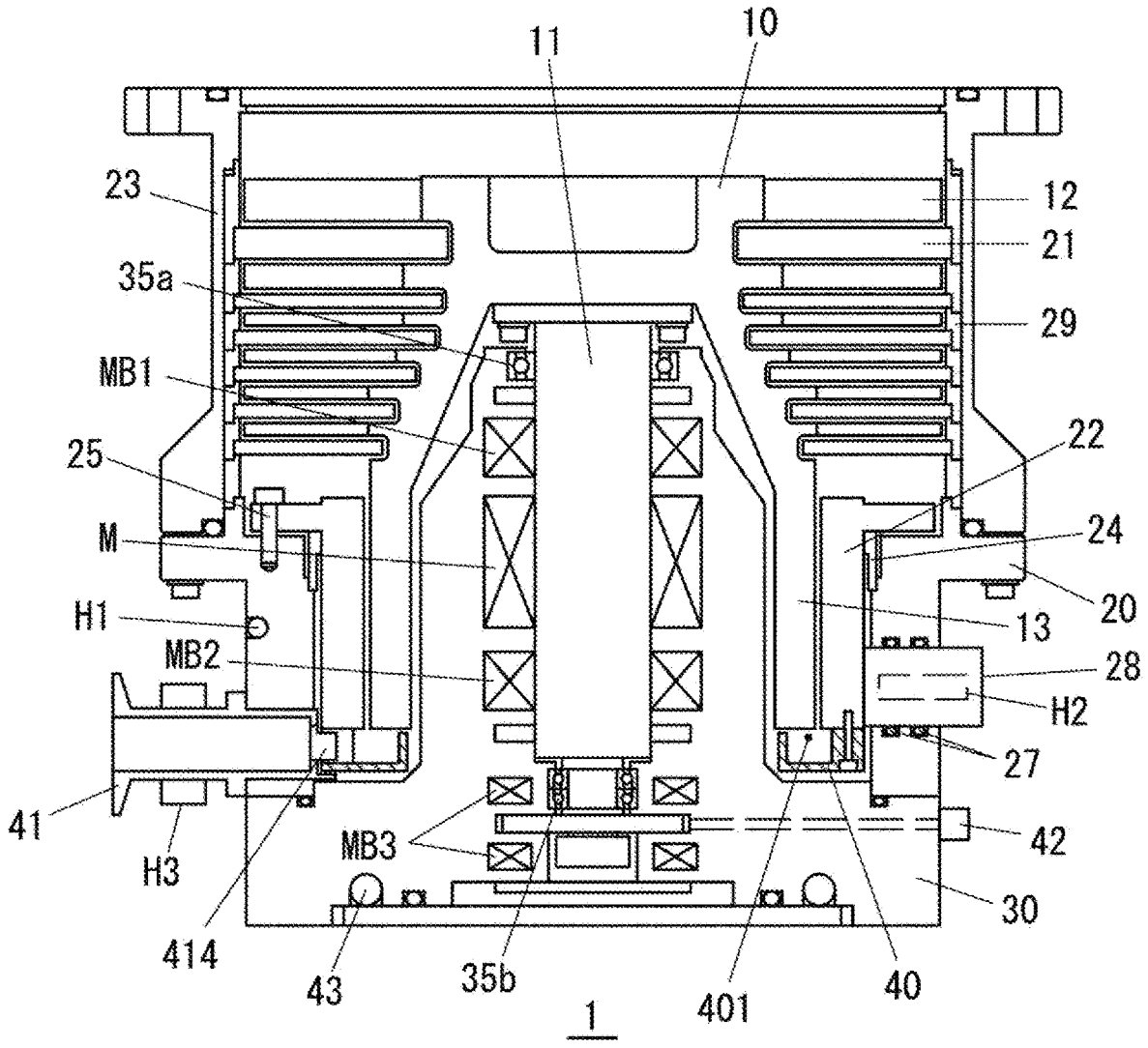
FIG. 1 is a view showing an embodiment of a vacuum pump according to the present invention, and shows the section of a turbo-molecular pump.

Hereinafter, a mode for carrying out the present invention will be described with reference to the drawings. FIG. 1 is a view showing an embodiment of a vacuum pump according to the present invention, and shows the section of a turbo-molecular pump. The turbo-molecular pump 1 includes a rotor 10 formed with multiple stages of rotor blades 12 and a rotor cylindrical portion 13 and a stator formed with multiple stages of stationary blades 21 and a stator cylindrical portion 22. The multiple stages of the stationary blades 21 are arranged and stacked corresponding to the multiple stages of the rotor blades 12 in a first pump case 23. The multiple stages of the rotor blades 12 and the multiple stages of the stationary blades 21 form a turbo pump portion. The multiple stages of the stationary blades 21 stacked in a pump axial direction are arranged on a second pump case 20 through spacers 29. Multiple turbine blades arranged in a circumferential direction are formed at each of the rotor blades 12 and the stationary blades 21. The first pump case 23 is fixed to the second pump case 20 with bolts, and the second pump case 20 is fixed to a base 30 with a not-shown fixing unit.

The stator cylindrical portion 22 in a cylindrical shape is arranged on an outer peripheral side of the rotor cylindrical portion 13 with a predetermined gap. The stator cylindrical portion 22 is placed on the second pump case 20 through a heat insulating member 24 with a low heat conductivity, and is fixed to the second pump case 20 with bolts 25. A screw groove is formed at either one of an outer peripheral surface of the rotor cylindrical portion 13 or an inner peripheral surface of the stator cylindrical portion 22, and the rotor cylindrical portion 13 and the stator cylindrical portion 22 form a screw groove pump portion.

A gas passage container 40 for preventing product accumulation on the base 30 and the second pump case 20 is fixed to a lower end of the stator cylindrical portion 22 with bolts. A case-side end portion (a right end portion as viewed in the figure) of an exhaust port 41 provided at the second pump case 20 is inserted into the gas passage container 40. Gas discharged by the turbo pump portion including the rotor blades 12 and the stationary blades 21 and the screw groove pump portion including the rotor cylindrical portion 13 and the stator cylindrical portion 22 is discharged through the exhaust port 41 after having flowed into the gas passage container 40.

A rotor shaft 11 is fixed to the rotor 10. The rotor shaft 11 is magnetically levitated and supported by radial magnetic bearings MB1, MB2 and an axial magnetic bearing MB3, and is rotatably driven by a motor M. When the magnetic bearings MB1 to MB3 are not in operation, the rotor shaft 11 is supported by mechanical bearings 35*a*, 35*b*. Note that in the present embodiment, the second pump case 20 and the base 30 are separated from each other, but it may be configured such that the second pump case 20 and the base 30 are integrally formed.

At the base 30 provided with electrical components such as the motor M and the magnetic bearings MB1 to MB3, a purge gas injection portion 42 for injecting purge gas such as inert gas into the base 30 is provided for preventing an adverse effect such as corrosion due to entry of discharged process gas. Purge gas injected into the base 30 reaches an exhaust side of the screw groove pump portion through a clearance between the base 30 and the rotor 10 by way of a clearance formed by the mechanical bearing 35*a* on the upper side as viewed in the figure, and is discharged to the outside of the pump through the exhaust port 41.

In the present embodiment, the second pump case 20 and the base 30, the stator cylindrical portion 22, and the exhaust port 41 are controlled to different temperatures. The second pump case 20 and the base 30 are controlled to a temperature T1 by a heater H1 provided at the second pump case 20 and a cooling pipe 43 provided at the base 30. A heating section 28 including a heater H2 is provided at the stator cylindrical portion 22, and the stator cylindrical portion 22 is controlled to a temperature T2. The exhaust port 41 is controlled to a temperature T3 by a heater H3.

The temperatures T2, T3 of the stator cylindrical portion 22 and the exhaust port 41 facing a passage for process gas to be discharged are controlled to relatively-high temperatures for reducing product accumulation. The temperatures T2, T3 are set considering, e.g., a relationship between the steam pressure and temperature of process gas and creep strain of the rotor cylindrical portion 13 rotating at high speed. Considering the relationship between the steam pressure and temperature of process gas, a component arranged in a higher-pressure (lower-vacuum) region needs to be at a higher temperature. Thus, the temperatures T2, T3 are set as in T3>T2.

Meanwhile, the temperature T1 of the base 30 and the second pump case 20 not facing the exhaust gas passage is controlled to a lower temperature than the temperatures T2, T3 of the stator cylindrical portion 22 and the exhaust port 41. Specifically, the electrical components such as the motor M and the magnetic bearings MB1 to MB3 are provided at the base 30, and therefore, the temperature T1 cannot be set high with no reason and the cooling pipe 43 in which refrigerant flows is provided for suppressing an excessive increase in the temperatures of the electrical components due to influence of heat generation from the electrical components themselves and influence of heating by the heater.

The heating section 28 configured to heat the stator cylindrical portion 22 is provided to penetrate the second pump case 20 from the outer peripheral side to an inner peripheral side. A tip end of the heating section 28 inserted into an internal space of the second pump case 20 thermally contacts an outer peripheral surface of the stator cylindrical portion 22. A back end of the heating section 28 is exposed to the outside of the base 30, and a clearance between the heating section 28 and the base 30 is sealed by an O-ring 27.

Figure 2:
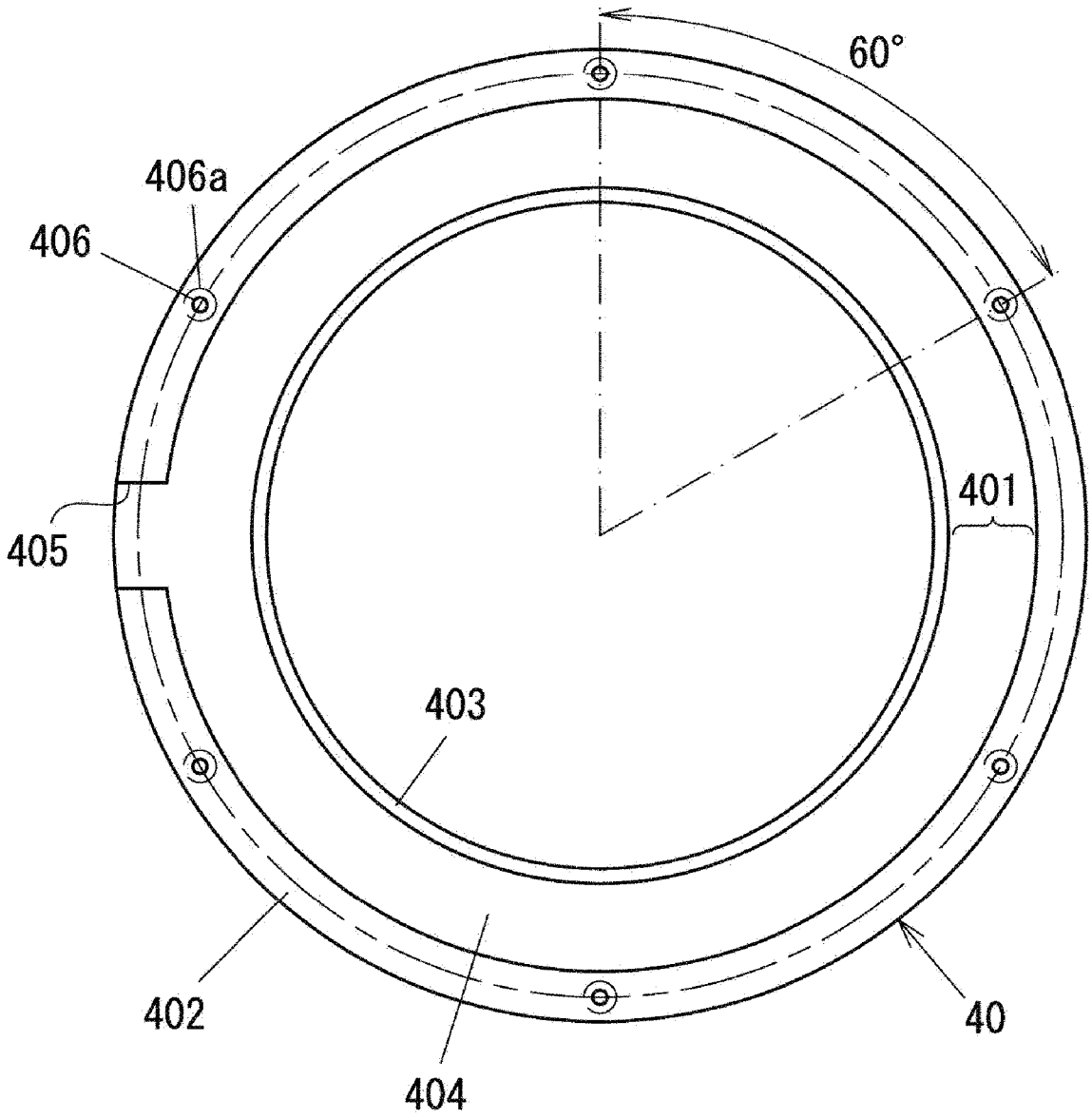
FIG. 2 is a plan view of a gas passage container.

FIG. 2 is a view showing the gas passage container 40 attached to the lower end of the stator cylindrical portion 22, and is a plan view from a stator side. The gas passage container 40 is a ring-shaped container, and has an outer peripheral wall 402 fixed to the stator cylindrical portion 22, an inner peripheral wall 403, and a bottom wall 404. Multiple bolt holes 406 having counterbores 406*a* are formed at the outer peripheral wall 402. Utilizing the bolt holes 406, the outer peripheral wall 402 of the gas passage container 40 is fixed to a lower end surface of the stator cylindrical portion 22.

A ceiling region (a region between the outer peripheral wall 402 and the inner peripheral wall 403) of the gas passage container 40 facing the stator cylindrical portion 22 forms a circular ring-shaped opening (hereinafter referred to as an inlet port) 401 into which gas discharged from the screw groove pump portion (the rotor cylindrical portion 13 and the stator cylindrical portion 22) flows. At the outer peripheral wall 402, an outlet port 405 as a tunnel-shaped passage is formed at a position facing the exhaust port 41 (see FIG. 1). Gas having flowed into the gas passage container 40 through the inlet port 401 is discharged to the exhaust port 41 through the outlet port 405, and is further discharged to the outside of the pump through the exhaust port 41.

Figure 3:
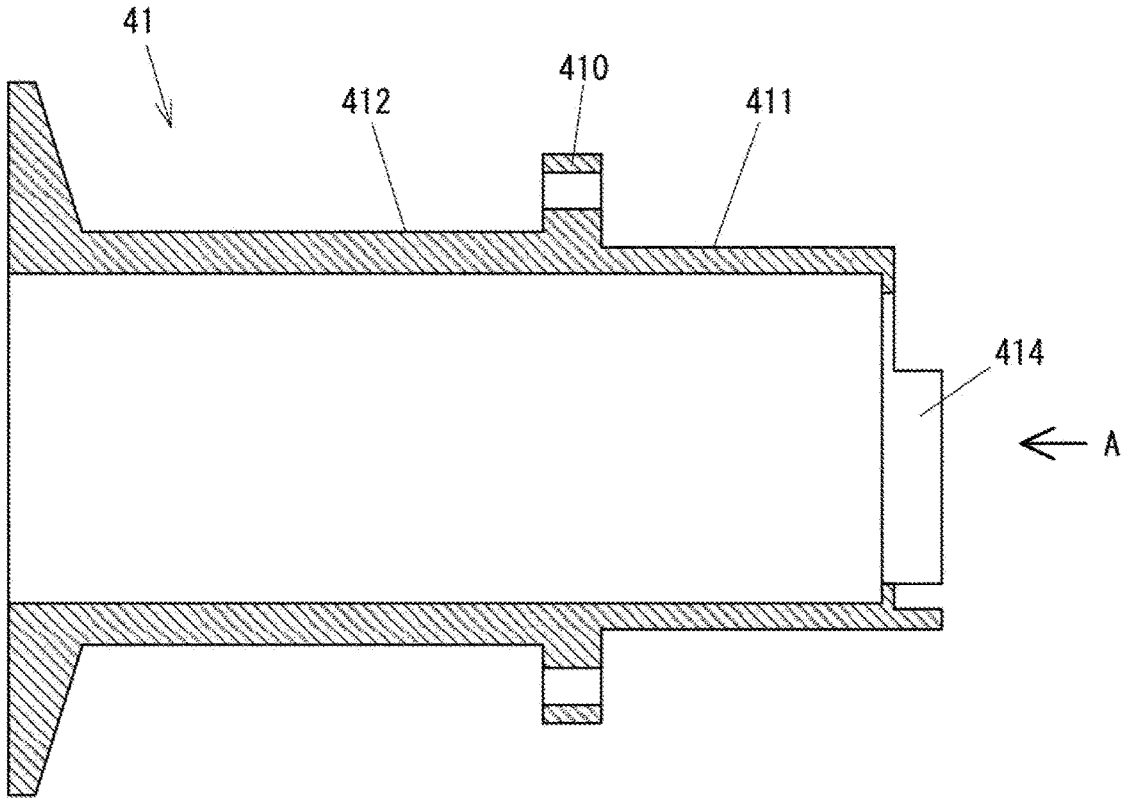
FIG. 3 is a sectional view of an exhaust port.
Figure 4:
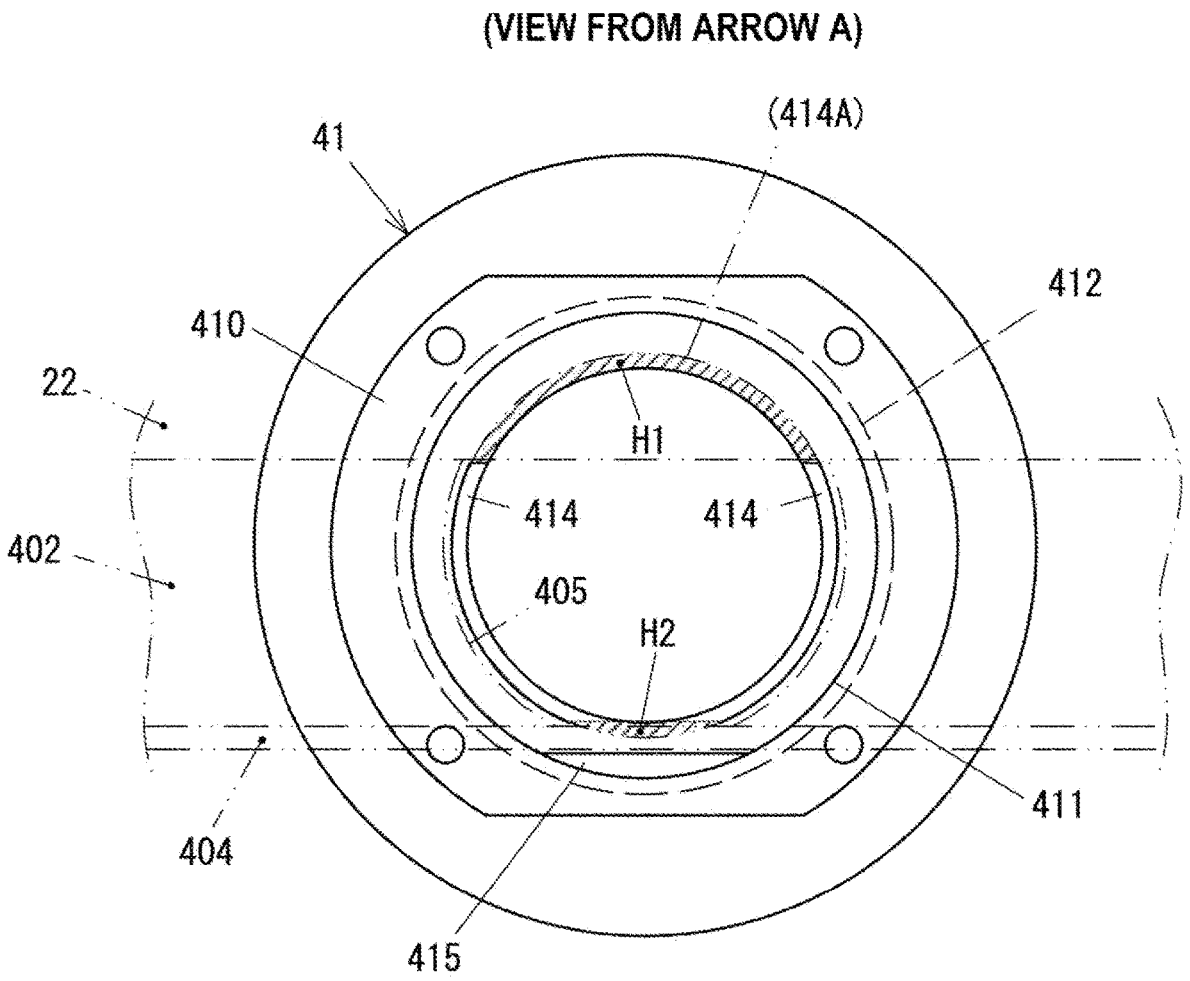
FIG. 4 is a view from an arrow A of FIG. 3.

FIGS. 3 and 4 are views for describing the shape of the exhaust port 41, FIG. 3 being a sectional view of the exhaust port 41 and FIG. 4 being a view from an arrow A of FIG. 3. Note that in FIG. 4, the stator cylindrical portion 22 and the gas passage container 40 into which a tip end portion of the exhaust port 41 is inserted are indicated by chain double-dashed lines. The exhaust port 41 includes a flange 410 for fixing the exhaust port 41 to the second pump case 20. The exhaust port 41 has a first pipe portion 411 to be inserted into the pump as shown on the right side of the flange 410 as viewed in the figure and a second pipe portion 412 exposed to the outside of the pump as shown on the left side of the flange 410 as viewed in the figure. As shown in FIG. 1, the heater H3 is attached to the second pipe portion 412. An insertion portion 414 to be inserted into the outlet port 405 of the gas passage container 40 is provided at a tip end of the first pipe portion 411.

As seen from the view of FIG. 4 from the arrow A, the insertion portion 414 is a portion remaining after hatched portions H1, H2 have been removed from a circular pipe 414A formed to protrude from the flange 410. Note that the removed portion H1 is a portion which is to contact the stator cylindrical portion 22 and the removed portion H2 is a portion which is to contact the bottom wall 404 of the gas passage container 40. The insertion portion 414 is inserted with a slight clearance between the insertion portion 414 and a wall portion of the outlet port 405 formed at the outer peripheral wall 402. A raised portion 415 is formed on the lower side of the insertion portion 414 as viewed in the figure. The raised portion 415 is arranged at a bottom portion of the outlet port 405, i.e., on the lower side of the bottom wall 404, with a clearance.

Figure 5:
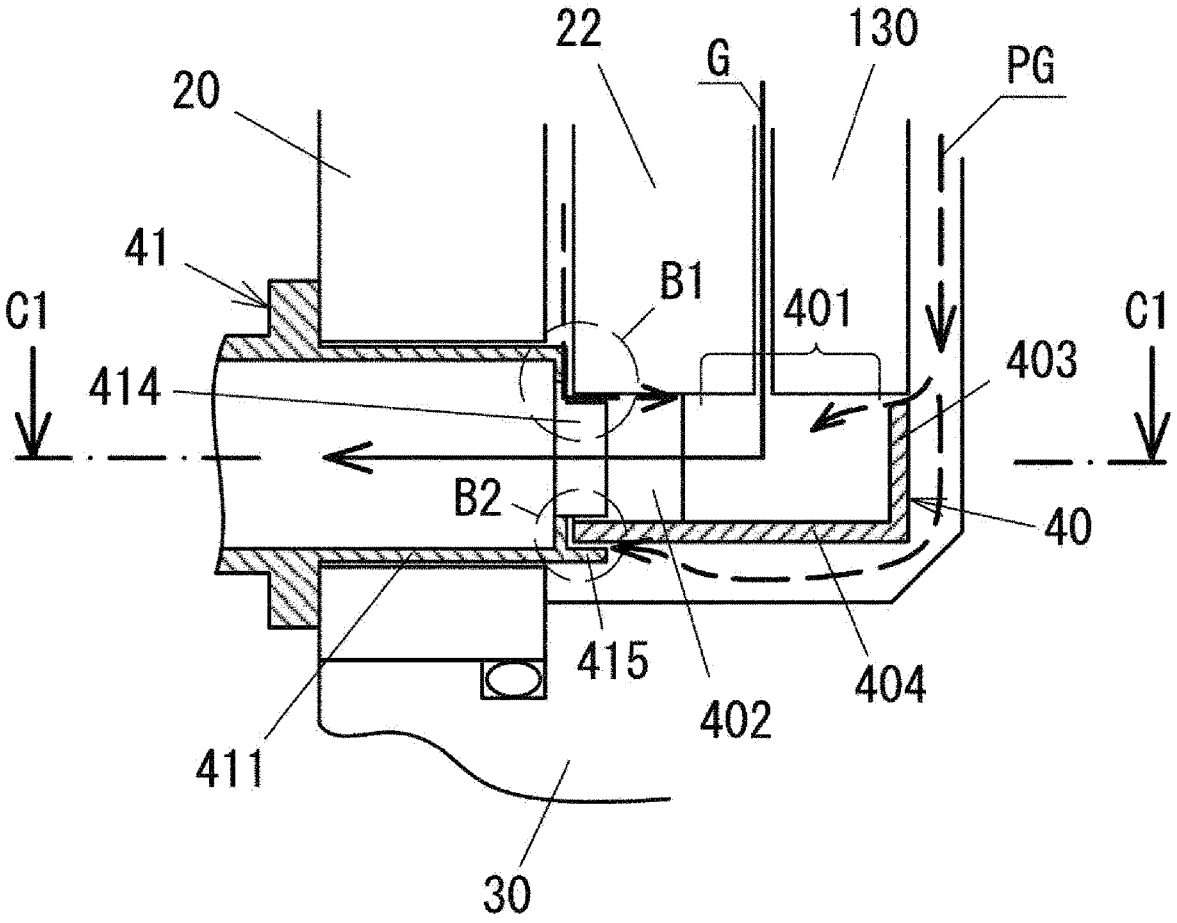
FIG. 5 is an axial sectional view for describing the flow of gas in a region where the gas passage container is arranged.
Figure 6:
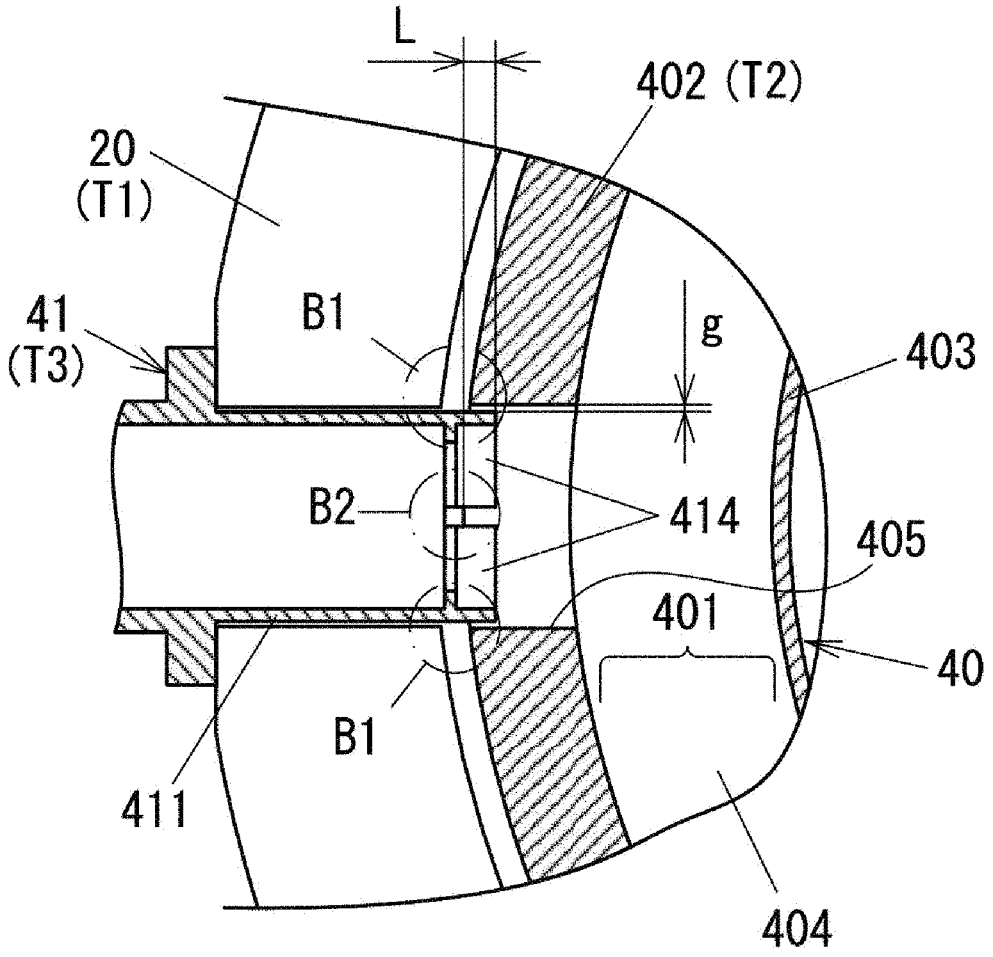
FIG. 6 is a sectional view along a C1-C1 line of FIG. 5.

FIGS. 5 and 6 are views for describing the flow of gas in the gas passage container 40 and the exhaust port 41. FIG. 5 shows an axial section similar to that in the case of FIG. 1, and FIG. 6 is a sectional view along a C1-C1 line of FIG. 5. In FIG. 5, a solid arrow indicates the flow of exhaust gas G, and a dashed arrow indicates the flow of purge gas PG. The gas passage container 40 is fixed to the stator cylindrical portion 22 controlled to the temperature T2, and therefore, has the substantially same temperature as that of the stator cylindrical portion 22. Note that instead of heating the gas passage container 40 with the gas passage container 40 being fixed to the stator cylindrical portion 22, the heating section 28 may contact both of the stator cylindrical portion 22 and the gas passage container 40, and the gas passage container 40 may be directly heated by the heating section 28. Alternatively, the gas passage container 40 may be heated by another heating section different from the heating section 28 such that the gas passage container 40 reaches the substantially same temperature as that of the stator cylindrical portion 22.

The gas passage container 40 is provided for avoiding exposure of the surfaces of the base 30 and the second pump case 20 to the flow of gas discharged from the screw groove pump portion. The pump-side tip end (the insertion portion 414 of the first pipe portion 411) of the exhaust port 41 is inserted into the outlet port 405. Thus, the exhaust gas G discharged from the screw groove pump portion (the rotor cylindrical portion 13 and the stator cylindrical portion 22) flows into the gas passage container 40 through the inlet port 401, passes through the gas passage container 40 without contacting the base 30 and the second pump case 20, and flows into the first pipe portion 411 through the insertion portion 414 inserted into the outlet port 405.

The exhaust port 41 and the stator cylindrical portion 22 are controlled to the different temperatures T3, T2 (<T3) by the different heaters. Thus, in regions B1, B2 of FIGS. 5 and 6, a slight clearance is formed between the first pipe portion 411 and the insertion portion 414 of the exhaust port 41, and, the stator cylindrical portion 22 and the gas passage container 40, such that the first pipe portion 411 and the insertion portion 414 do not contact to the stator cylindrical portion 22 and the gas passage container 40. With such a configuration, heat transfer between the exhaust port 41 and the stator cylindrical portion 22 at the different temperatures is prevented, and stability in control of the exhaust port 41 and the stator cylindrical portion 22 to the different target temperatures T3, T2 is improved.

At a connection portion between the first pipe portion 411 and the gas passage container 40, the insertion portion 414 of the first pipe portion 411 is, for avoiding contact between the first pipe portion 411 and the gas passage container 40, inserted into the outlet port 405 formed in a tunnel shape at the outer peripheral wall 402 with a slight clearance. Thus, the gas conductance of the clearance space between the insertion portion 414 and the outlet port 405 can be decreased, and the amount of exhaust gas G leaking from the clearance can be suppressed small. For example, in a case where a clearance dimension is g, the amount of insertion of the insertion portion 414 is L, and $L=\alpha \cdot g$ is satisfied, the degree of $\alpha$ is substantially set to 2 or greater so that the gas leakage amount can be sufficiently decreased (e.g., $\alpha=2$ and $g=1$ are set). In the region B2, the raised portion 415 is arranged on the lower side of the bottom wall 404 of the gas passage container 40 as viewed in the figure, and a clearance among the insertion portion 414, the raised portion 415, and the bottom wall 404 forms a labyrinth-like structure. Thus, leakage of the exhaust gas G to a region surrounding the gas passage container 40 can be further decreased.

As described above, the present embodiment employs such a structure that the gas passage container 40 is provided and the insertion portion 414 of the first pipe portion 411 is inserted into the tunnel-shaped outlet port 405 of the gas passage container 40, and therefore, gas leakage through the clearance formed by the insertion portion can be sufficiently decreased. As a result, contact of the exhaust gas G with inner peripheral surfaces of the base 30 and the second pump case 20 is suppressed as much as possible, and product accumulation on these inner peripheral surfaces can be suppressed small.

The purge gas PG injected into the base 30 through the purge gas injection portion 42 flows downwardly in a clearance between the rotor cylindrical portion 13 and the base 30 as indicated by the dashed arrows, and the region surrounding the gas passage container 40 arranged on the exhaust side of the screw groove pump portion is filled with the purge gas PG. Such purge gas PG enters the gas passage container 40 through a clearance between the inner peripheral wall 403 of the gas passage container 40 and the rotor cylindrical portion 13 and the clearances in the regions B1, B2, and is discharged to the outside of the pump through the exhaust port 41. Thus, the purge gas PG flowing in through the clearances can prevent the exhaust gas G from leaking to the outside of the gas passage container 40 through the clearances in the regions B1, B2, and product accumulation on the inner peripheral surfaces of the base 30 and the second pump case 20 can be more effectively prevented.

Figure 7:
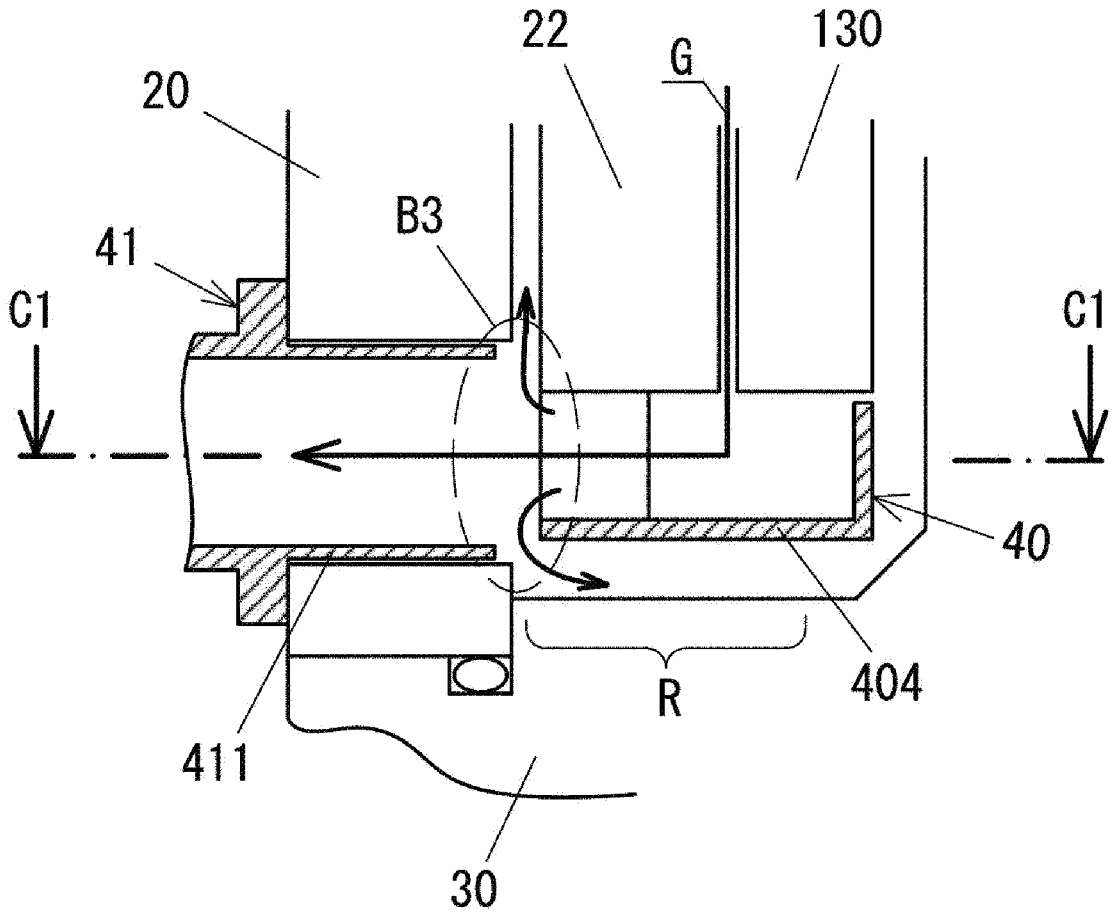
FIG. 7 is an axial sectional view showing a comparative example.
Figure 8:
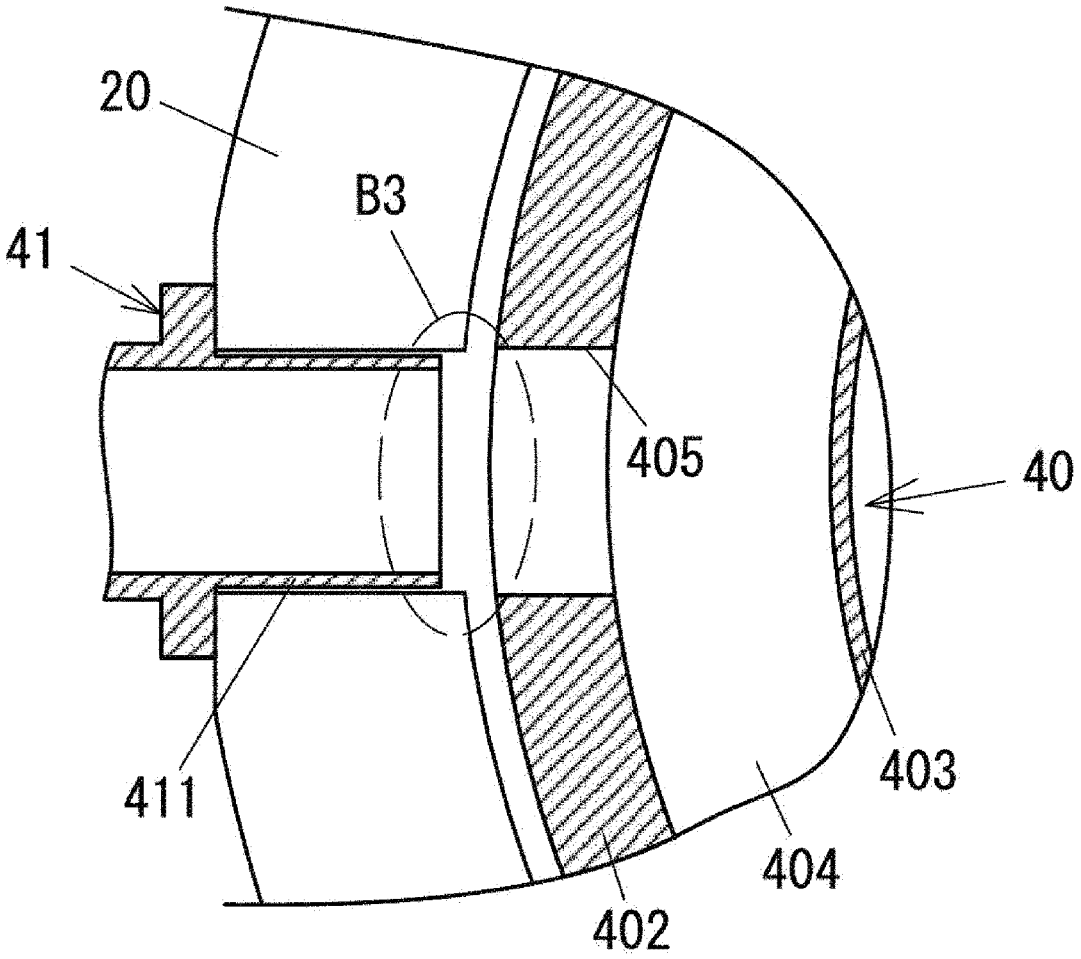
FIG. 8 is a sectional view along a C1-C1 line of FIG. 7.

FIGS. 7 and 8 show, as a comparative example, one example in a case where the tip end of the first pipe portion 411 is not inserted into the gas passage container 40. FIG. 7 is an axial sectional view similar to that of FIG. 5, and FIG. 8 is a sectional view along a C1-C1 line of FIG. 7. In the case of the comparative example, the first pipe portion 411 is not inserted into the gas passage container 40, and a clearance between the first pipe portion 411 and the gas passage container 40 in a region B3 is relatively large. Thus, exhaust gas is likely to leak to the base 30 and the second pump case 20 through the clearance. For this reason, a product is accumulated on the inner peripheral surfaces of these components. Specifically, the product is likely to be accumulated on a surface R, which is close to the clearance, of the base 30 cooled by the cooling pipe 43. Even if the purge gas PG is injected into the exhaust side of the screw groove pump portion as in the case of FIG. 5, a leakage prevention effect by the purge gas PG flowing into the exhaust port 41 is degraded due to the large clearance, and for this reason, the product is likely to be accumulated on the inner peripheral surface in the vicinity of the clearance.

The embodiment describes such a structure that the purge gas PG injected into a motor arrangement space of the base 30 flows around to the exhaust side of the screw groove pump portion, but the purge gas supply configuration is not limited to such a structure. For example, it may be configured such that the purge gas PG is directly injected into the exhaust side of the screw groove pump portion.

(Variations)

Figure 9A:
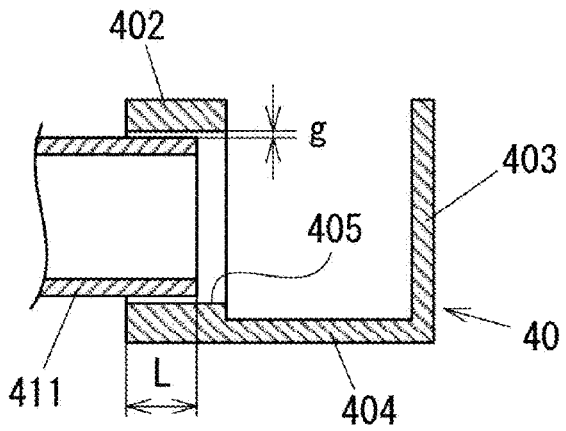
FIGS. 9A to 9C are views showing first to third variations.
Figure 9B:
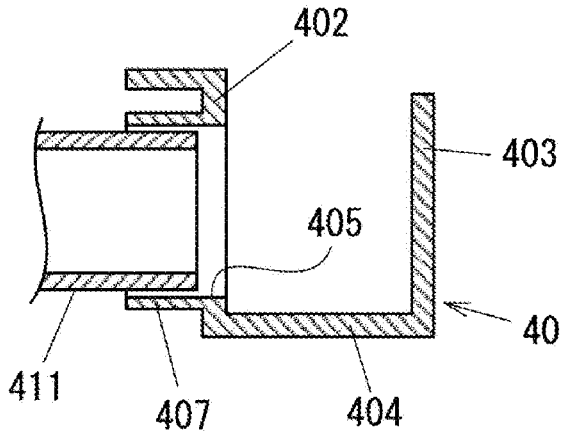
Figure 9C:
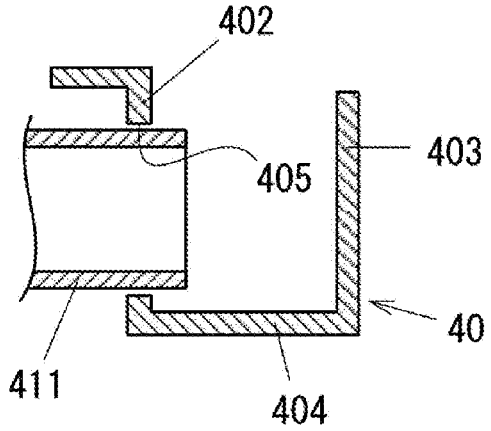

FIGS. 9A to 9C are views showing variations of the outlet port 405. In a first variation shown in FIG. 9A, the outlet port 405 having a circular sectional shape is formed at the outer peripheral wall 402, and the tip end portion of the first pipe portion 411 of the exhaust port 41 is inserted into the outlet port 405. The amount of insertion of the first pipe portion 411 is L as described above, and the dimension of a gap between the first pipe portion 411 and the outlet port 405 is g as described above.

In a second variation shown in FIG. 9B, an insertion portion 407 formed with the tunnel-shaped outlet port 405 is formed to protrude to the outer peripheral side from the thin outer peripheral wall 402. The outer peripheral wall 402 is formed thin so that the weight of the gas passage container 40 can be reduced. Needless to say, the insertion portion 407 may be formed to protrude to the inner peripheral side of the outer peripheral wall 402.

In a third variation shown in FIG. 9C, the case of the outlet port 405 not formed in the tunnel shape is shown. The outlet port 405 is formed at the thin outer peripheral wall 402, and the first pipe portion 411 of the exhaust port 41 is inserted into the outlet port 405 such that the tip end of the first pipe portion 411 protrudes into the container. In the case of the third variation, the gas leakage amount is greater than that in a case where the outlet port 405 is formed in the tunnel shape as in the first and second variations, but due to the insertion structure, can be reduced as compared to the case of the comparative example of FIGS. 7 and 8.

Those skilled in the art understand that the above-described exemplary embodiment and variations are specific examples of the following aspects.

[1] A vacuum pump comprises: a rotor formed with multiple stages of rotor blades and a rotor cylindrical portion; a stator formed with multiple stages of stationary blades and a stator cylindrical portion arranged with a predetermined gap from the rotor cylindrical portion; a first heating section configured to heat the stator cylindrical portion to a temperature for reducing product accumulation; an exhaust pipe provided at a housing storing the rotor and the stator to discharge gas discharged by the rotor and the stator to an outside of the housing; a second heating section configured to heat the exhaust pipe to a temperature for reducing product accumulation; and a gas passage container arranged in the housing, having an inlet port into which gas discharged through a gap between the rotor cylindrical portion and the stator cylindrical portion flows and an outlet port from which inflow gas flows to the exhaust pipe, and heated to a temperature for reducing product accumulation. A gas-inflow-side end portion of the exhaust pipe is inserted into the outlet port of the gas passage container through a clearance.

Specifically, the region where gas is discharged through the gap between the rotor cylindrical portion 13 and the stator cylindrical portion 22 is under low vacuum, and for this reason, the product is likely to be accumulated on the inner peripheral surfaces of the base 30 and the second pump case 20. However, the heated gas passage container is provided so that product accumulation on the inner peripheral surfaces of the base 30 and the second pump case 20 can be reduced. For example, as shown in FIG. 5, the insertion portion 414 at the tip end of the first pipe portion 411 is inserted into the outlet port 405 of the gas passage container 40. With such an insertion structure, leakage of exhaust gas through the clearance between the insertion portion 414 and the outlet port 405 can be reduced, and product accumulation on the inner peripheral surfaces of the base 30 and the second pump case 20 can be reduced.

[2] The outlet port is a tunnel-shaped hole, and the gas-inflow-side end portion of the exhaust pipe is inserted such that a clearance is formed between the gas-inflow-side end portion and a wall surface of the tunnel-shaped hole.

For example, as shown in FIGS. 5 and 6, the outlet port 405 is the tunnel-shaped hole formed to penetrate the thick outer peripheral wall 402. Thus, in the clearance space, the length dimension L is greater than the gap dimension g, and therefore, the gas conductance can be increased and gas leakage through the clearance can be further reduced.

[3] The gas passage container is a ring-shaped container, and the inlet port is a ring-shaped opening facing an entirety of gas exhaust regions of the rotor cylindrical portion and the stator cylindrical portion.

The gas passage container is the ring-shaped container, and therefore, is arranged across the entirety of the ring-shaped space downstream of an exhaust functional section.

[4] The gas passage container is heated by the first heating section.

[5] The gas passage container is fixed to the stator cylindrical portion, and is heated by the first heating section through the stator cylindrical portion.

For example, as shown in FIG. 5, the gas passage container 40 is fixed to the stator cylindrical portion 22, and is directly or indirectly heated by the heating section 28. Thus, another heating section dedicated to the gas passage container 40 is not necessarily prepared.

[6] The vacuum pump further comprises: a purge gas injection portion for injecting purge gas into a space surrounding the gas passage container. The gas injected into the surrounding space prevents gas discharged from the gap between the rotor cylindrical portion and the stator cylindrical portion from leaking to a periphery of the gas passage container.

For example, as shown in FIG. 5, the purge gas PG is injected into the space surrounding the gas passage container 40, and accordingly, flows into the gas passage container 40 through the clearance among the members (the rotor cylindrical portion 13, the insertion portion 414, the stator cylindrical portion 22 and the like) close to the gas passage container 40. Thus, leakage of exhaust gas (process gas) to the surrounding space through the clearance can be reduced. As a result, product accumulation on the inner peripheral surfaces of the base 30 and the second pump case 20 can be further reduced.

[7] The exhaust pipe includes, in addition to the gas-inflow-side end portion inserted into the outlet port through the clearance, a raised portion arranged in parallel with the gas-inflow-side end portion and protruding inward of the housing, and part of a wall portion of the gas passage container is arranged between the gas-inflow-side end portion and the raised portion through a clearance.

For example, as shown in FIG. 5, the raised portion 415 is arranged on the lower side of the bottom wall 404 of the gas passage container 40 as viewed in the figure, and the clearance among the insertion portion 414, the raised portion 415, and the bottom wall 404 forms the labyrinth-like structure. Thus, leakage of the exhaust gas G to the region surrounding the gas passage container 40 can be further reduced.

The various embodiments and the variations have been described above, but the present invention is not limited to the contents of these embodiments and variations. The scope of the present invention also includes other aspects conceivable within the scope of the technical idea of the present invention. For example, in the above-described embodiments, the turbo-molecular pump has been described as an example, but the present invention is also applicable to a vacuum pump having only a screw groove pump including a stator and a rotor cylindrical portion.

What is claimed is:

1. A vacuum pump comprising:

a rotor formed with multiple stages of rotor blades and a rotor cylindrical portion;

a stator formed with multiple stages of stationary blades and a stator cylindrical portion arranged with a predetermined gap from the rotor cylindrical portion;

a housing including: a first pump case in which the rotor blades and the stationary blades are arranged, a second pump case in which the rotor cylindrical portion and the stator cylindrical portion are arranged, and a base;

a first heating section configured to heat the stator cylindrical portion to a temperature for reducing product accumulation;

an exhaust pipe provided at the second pump case storing the rotor cylindrical portion and the stator cylindrical portion to discharge gas discharged by the rotor and the stator to an outside of the second pump case;

a second heating section configured to heat the exhaust pipe to a temperature for reducing product accumulation; and a gas passage container preventing product accumulation on the second pump case and the base, the gas passage container being formed of a discrete body with U-shaped cross section constituted by an outer peripheral wall covering an inner peripheral wall of the second pump case, an inner peripheral wall covering an outer peripheral wall of the base, and a bottom wall covering a bottom surface of the base, having an inlet port at an opening of the U-shaped body into which gas discharged through the predetermined gap between the rotor cylindrical portion and the stator cylindrical portion flows and an outlet port in the outer peripheral wall from which inflow gas flows to the exhaust pipe, and heated to a temperature for reducing product accumulation, wherein a gas-inflow-side end portion of the exhaust pipe is inserted into the outlet port of the gas passage container through a clearance.

2. The vacuum pump according to claim 1, wherein the outlet port is an elongate hole extending through an outer peripheral wall of the gas passage container, and the gas-inflow-side end portion of the exhaust pipe is inserted such that a clearance is formed between the gas-inflow-side end portion and a wall surface of the elongate hole.

3. The vacuum pump according to claim 2, wherein the dimension of the clearance is g, the amount of insertion of the gas-inflow-side end portion of the exhaust pipe is L, and $L=\alpha \cdot g$ is satisfied, wherein the degree of $\alpha$ is set to 2 or greater.

4. The vacuum pump according to claim 1, wherein the gas passage container is a ring-shaped container, and the inlet port is a ring-shaped opening facing an entirety of gas exhaust regions of the rotor cylindrical portion and the stator cylindrical portion.

5. The vacuum pump according to claim 1, wherein the gas passage container is heated by the first heating section.

6. The vacuum pump according to claim 5, wherein the gas passage container is fixed to the stator cylindrical portion, and is heated by the first heating section through the stator cylindrical portion.

7. The vacuum pump according to claim 1, further comprising:

a purge gas injection portion for injecting purge gas into a space surrounding the gas passage container, wherein the gas injected into the surrounding space prevents gas discharged from the predetermined gap between the rotor cylindrical portion and the stator cylindrical portion from leaking to a periphery of the gas passage container.

8. The vacuum pump according to claim 1, wherein the exhaust pipe includes, in addition to the gas-inflow-side end portion inserted into the outlet port through the clearance, a raised portion arranged in parallel with the gas-inflow-side end portion and protruding inward of the housing, and part of a wall portion of the gas passage container is arranged between the gas-inflow-side end portion and the raised portion through a clearance.

9. The vacuum pump according to claim 8, wherein the clearance forms a labyrinth structure.

10. The vacuum pump according to claim 1, wherein the gas passage container is a ring-shaped container.

11. The vacuum pump according to claim 10, wherein multiple bolt holes having counterbores are formed at the outer peripheral wall, and utilizing the bolt holes, the outer peripheral wall of the gas passage container is fixed to a lower end surface of the stator cylindrical portion.

12. The vacuum pump according to claim 1, wherein a clearance is formed between the gas-inflow-side end portion of the exhaust pipe and the stator cylindrical portion.

* * * * *